US007225838B2

(12) United States Patent
Wahhoud et al.

(10) Patent No.: US 7,225,838 B2
(45) Date of Patent: Jun. 5, 2007

(54) METHOD FOR PRODUCING A FABRIC IN PLAIN WEAVES AND LENO WEAVES AND A LOOM FOR CARRYING OUT THE METHOD

(75) Inventors: Adnan Wahhoud, Lindau (DE); Peter Czura, Wangen (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 10/546,444

(22) PCT Filed: Feb. 18, 2004

(86) PCT No.: PCT/DE2004/000293

§ 371 (c)(1),
(2), (4) Date: Aug. 30, 2005

(87) PCT Pub. No.: WO2004/076729

PCT Pub. Date: Sep. 10, 2004

(65) Prior Publication Data

US 2006/0144458 A1 Jul. 6, 2006

(30) Foreign Application Priority Data

Feb. 21, 2003 (DE) ..... 103 07 489
Jul. 25, 2003 (DE) ..... 103 34 359

(51) Int. Cl.

| | |
|---|---|
| ***D03C 7/00*** | (2006.01) |
| ***D03C 7/06*** | (2006.01) |
| ***D03C 7/08*** | (2006.01) |
| *D03D 41/00* | (2006.01) |
| *D03C 13/00* | (2006.01) |

(52) U.S. Cl. ..... 139/50; 139/11; 139/35; 139/51; 139/52; 139/53; 139/54; 139/55.1

(58) Field of Classification Search ..... 139/11, 139/20, 35, 50, 51, 52, 53, 54, 55.1
See application file for complete search history.

(56) References Cited

U.S. PATENT DOCUMENTS 3,463,199 A 8/1969 Crenshaw et al.
3,920,054 A * 11/1975 Goff et al. ..... 139/421

(Continued)

FOREIGN PATENT DOCUMENTS

DE 360112 9/1922

(Continued)

*Primary Examiner*—Robert H Muromoto
(74) *Attorney, Agent, or Firm*—W. F. Fasse; W. G. Fasse

(57) ABSTRACT

A loom simultaneously forms a plain weave (16) and a gauze weave (15) in a textile (9) in one weaving cycle. To form the plain weave (16), the adjacent warp threads ($\mathbf{1}_L$,$\mathbf{2}_L$) that are used to form the upper shed and lower shed are alternately lifted from the lower shed position into the upper shed position and lowered from the upper shed position into the lower shed position by the same drop wire/needle shank (4). To form the gauze weave (15), only the warp threads ($\mathbf{2}_D$) that form the upper shed are raised by the drop wire/needle shank (4) from the lower shed position into the upper shed position and lowered from the upper shed position into the lower shed position.

4 Claims, 7 Drawing Sheets

U.S. PATENT DOCUMENTS

| | | | | |
|---|---|---|---|---|
| 3,965,944 | A * | 6/1976 | Goff et al. | 139/421 |
| 4,614,210 | A * | 9/1986 | Debaes | 139/54 |
| 4,816,028 | A * | 3/1989 | Kapadia et al. | 623/1.52 |
| 5,018,230 | A * | 5/1991 | Steberger | 5/420 |
| 5,441,798 | A * | 8/1995 | Nishimura et al. | 442/205 |
| 6,257,283 | B1 | 7/2001 | Lenzi | |
| 6,378,566 | B1 * | 4/2002 | Kornett | 139/383 AA |
| 6,559,078 | B2 * | 5/2003 | Nozaki et al. | 442/43 |

FOREIGN PATENT DOCUMENTS

| | | |
|---|---|---|
| DE | 616709 | 8/1935 |
| DE | 646 462 | 6/1937 |
| DE | 101 28 538 | 1/2003 |
| EP | 0957191 | 11/1999 |

* cited by examiner 13a, 14a
12

12
13
A
13a
14
14a
A r
α

13
13a
β
β
14
14a 30
31
11a
10
11
10
11
10
12
10
13a; 14a

METHOD FOR PRODUCING A FABRIC IN PLAIN WEAVES AND LENO WEAVES AND A LOOM FOR CARRYING OUT THE METHOD

TITLE OF THE INVENTION

Method for producing fabric in plain weaves and leno weaves and a loom for carrying out the method.

FIELD OF THE INVENTION

The invention relates to a method for producing a fabric which has both plain weaves comprising weft and warp threads and leno weaves comprising weft and warp threads, and a loom a carrying out the method.

BACKGROUND INFORMATION

DE-PS 360 112 discloses a needle shaft device for producing types of fabric with alternate plain and leno weave.

The shafts are raised in a controlled manner in this instance by the slay being retracted by means of a carrier which is connected to the slay arm. By changing the manner in which the shafts are raised, it is possible to produce plain weave, and by successively raising the same shaft with lateral displacement thereof, it is possible to produce leno weave. In order to form the leno shed, a conventional shaft is laterally displaced with the shed in the closed state so that the warp threads of this shaft can be guided over the needle tips and warp threads of the other shaft which is a needle shaft.

If the needle shaft over whose needle tips the warp threads of the second shaft, that is to say, the conventional shaft, have been guided is raised, the leno shed is formed.

When the plain shed is formed, the lateral displacement of the warp threads is dispensed with; the shafts are raised alternately at regular intervals.

From the sequence described for forming a leno and plain shed, it can be seen that a fabric having alternate plain and leno weaves can be produced, that is to say, a plain weave can first be formed in the fabric and subsequently a leno weave. It is not disclosed how, during a weaving cycle, that is to say, from one reed beat-up operation to the next, both a plain weave fabric and a leno weave fabric can be produced.

Consequently, it is not disclosed what means could be provided for simultaneously producing weaves of this type in a fabric.

A device for producing a fabric having plain weaves and leno weaves is known from DE-PS 646 462 and has two needle combs which are located one above the other in one plane.

The needle combs are controlled independently of each other, whereby it is possible to change the weave during operation of the loom in such a manner that, after one or more leno weaves, plain weaves can also be produced.

However, the document does not disclose how plain and leno weaves can be formed in a fabric at the same time and what means are used for the production thereof.

A loom for producing a fabric comprising stationary, leno and weft threads is known from DE 101 28 538 A1.

This document also does not disclose how plain or leno weaves can be produced simultaneously during the production of fabric.

SUMMARY OF THE INVENTION

The object of the invention is to produce plain and leno weaves in a fabric which is to be produced during a weaving cycle, without the use of costly shed-forming means.

The object is achieved with a method and a loom for carrying out the method.

In accordance with the method according to the invention, it is possible to form plain and leno weaves in a fabric which is to be produced simultaneously during a weaving cycle.

In one configuration of the invention, there is provision, in order to form the plain weaves, for the mutually adjacent warp threads which are used to form a lower shed and an upper shed to be raised alternately by one and the same blade and needle shaft from the position of the lower shed into the position of the upper shed and conversely to be guided back into the position of the lower shed again.

At the same time as the plain shed is formed, the formation of the leno shed is brought about using the same blade and needle shaft in such a manner that only the warp threads which are used to form the leno upper shed are raised in a manner known per se.

In the case of a substantially raised plain and leno shed, in a manner known per se, at least one weft thread is inserted into the shed. The weft thread which has been inserted is subsequently beaten-up to the fabric edge.

When the at least one weft thread is beaten-up, the second blade and needle shaft which has raised the warp threads to form the upper shed moves over the shed closure into the lower shed position. At the same time, the first blade and needle shaft is displaced transversely relative to the path of the warp threads so that the warp threads which are guided into the first blade and needle shaft are displaced laterally back or forth relative to the warp threads which are guided in the second blade and needle shaft. When the warp threads are laterally displaced, the warp threads which previously formed the plain upper shed instead now form the plain lower shed, whilst the warp threads of the original plain lower shed are used to form a new plain upper shed and, at the same time, the warp threads originally used to form the leno upper shed are again used to form a leno upper shed.

Using this method of operation disclosed above for the first and second blade and needle shaft, a plain weave and a leno weave are produced simultaneously during a weaving cycle.

In the case of light medical dressing material which is, for example, woven as a strip in plain weave, it is possible to dispense with separate leno devices for producing secure fabric edges since, in accordance with the method according to the invention, plain weave can be carried out together with at least one leno weave at the fabric edges of the strip using only two blade and needle shafts.

In order to carry out the method according to the invention, a loom is provided which has means for forming a shed, means for inserting weft threads into the shed which has been formed and means for beating-up the weft thread which has been inserted into the shed to the beating-up edge of the fabric to be produced.

The means for forming the shed comprise, in known manner, a first blade and needle shaft which is connected to a drive which allows the first blade and needle shaft to move back and forth in an oscillating manner transversely relative to the warp threads and therefore relative to the weaving plane.

The means for forming the shed further comprise a second blade and needle shaft which is located beside the first blade and needle shaft and which is connected to a suitable means which acts in a rotationally fixed manner on a shaft which is arranged remote from the slay shaft of the loom, the driving action of this shaft being directed away from the slay shaft.

In order to form plain and leno weaves simultaneously in a fabric, there is provision according to the invention for a needle blade having thread guiding eyelets which are directed away from each other to be connected in each case between two of the rod blades which are arrested at the upper and lower shaft connection of the first and second blade and needle shaft on a portion of the operating width of the first and second blade and needle shaft intended for forming leno weaves, and for a plurality of mutually spaced-apart rod blades to be arranged beside each other in the first blade and needle shaft closest to the slay of the loom on another portion of the operating width of the first and second blade and needle shaft intended for forming plain weaves, with which rod blades there is associated a so-called shoulder blade, having a shoulder at one or both sides, in the second blade and needle shaft either of each even-numbered or each odd-numbered rod blade of the first blade and needle shaft. In another configuration of the invention, the shoulder blades comprise an elongate, planar member which is preferably of metal and which, according to the invention, has, at one location of the longitudinal extent thereof, a laterally protruding first and second shoulder on which a warp thread from the lower shed of the warp is guided into the upper shed and conversely from the position of the upper shed into the position of the lower shed at alternate sides in order to form a plain shed.

The shoulder may have a special construction; the shoulder may have a trough-like recess in order to be able to raise and lower the warp thread in a secure manner; the face of the shoulder which carries the warp thread can be planar and orientated at an angle $\alpha \leqq 90°$ relative to the longitudinal extent (longitudinal axis of the shoulder blade).

The protruding shoulders can be connected to the elongate member by means of a non-releasable connection and enclose an angle $\beta < 180°$.

However, each shoulder blade can also comprise a first elongate, planar member having a shoulder which is bent out from the planar side of the member and a second member which is constructed as a mirror image of the first member. Both members are then joined together in the upper and lower shaft connection of the blade and needle shaft in such a manner that these members form the shoulder blade having shoulders which are directed away from each other.

In another configuration of the invention, in order to form the plain weave fabric, each of the even-numbered or each of the odd-numbered rod blades of the first blade and needle shaft, that is to say, the blade and needle shaft which moves transversely, that is to say, horizontally relative to the weaving plane may have a shoulder blade which has at least a shoulder at one side for retaining the plain weave warp threads which are not involved in forming the upper shed. The shoulder of the shoulder blades that retains the plain weave warp thread is formed substantially in the plane of the thread guiding eyelet of the needle blades of the first blade and needle shaft.

In a preferred configuration, the shoulder is in the form of a trough-like recess which is open downwards. In contrast, the shoulder of the shoulder blades of the second blade and needle shaft forms a trough-like recess which is open upwards. In another configuration of the invention, the shoulder blade is in the form of an elongate planar member which is preferably of metal and which has, at one side in the region of the longitudinal extent thereof, a shoulder which is directed counter to the supply direction of the warp.

Instead of the shoulder, it is possible to provide a trough-like recess in the corresponding rod blade in the relevant region of the longitudinal extent thereof. The trough-like recess terminates in a hook shape.

The recess may further have different geometric configurations; the important aspect is for the relevant warp thread to be able to be collected through the respective recess in the rod blade of the first blade and needle shaft and to be retained in the predetermined position thereof when the shed is formed.

Using the solutions according to the invention it is for the first time possible to produce fabrics in plain weaves and leno weaves during a weaving cycle on looms having no additional shed forming machine including shafts having healds and beams.

Since additional shafts are dispensed with, the front shed can have a shorter construction in looms of this type. The warp threads of the lower shed are relatively undisturbed so that, for example, in air jet looms, the lower shed is not displaced a large distance below the lower projection of the weft insertion duct which extends in the reed.

With the solution according to the invention, a retainer for the warp threads is also advantageously dispensed with in the region of the rear shed; warp thread holders in the region of the shed forming devices are completely avoided and fabric having faulty plain weaving is prevented.

Further advantageous effects of the invention will be appreciated from the patent claims and the following embodiments.

BRIEF DESCRIPTION OF THE DRAWINGS

The invention is explained in greater detail below with reference to one embodiment and the appended drawings, in which.

DETAILED DESCRIPTION OF EXAMPLE EMBODIMENTS OF THE INVENTION

Figure 1:
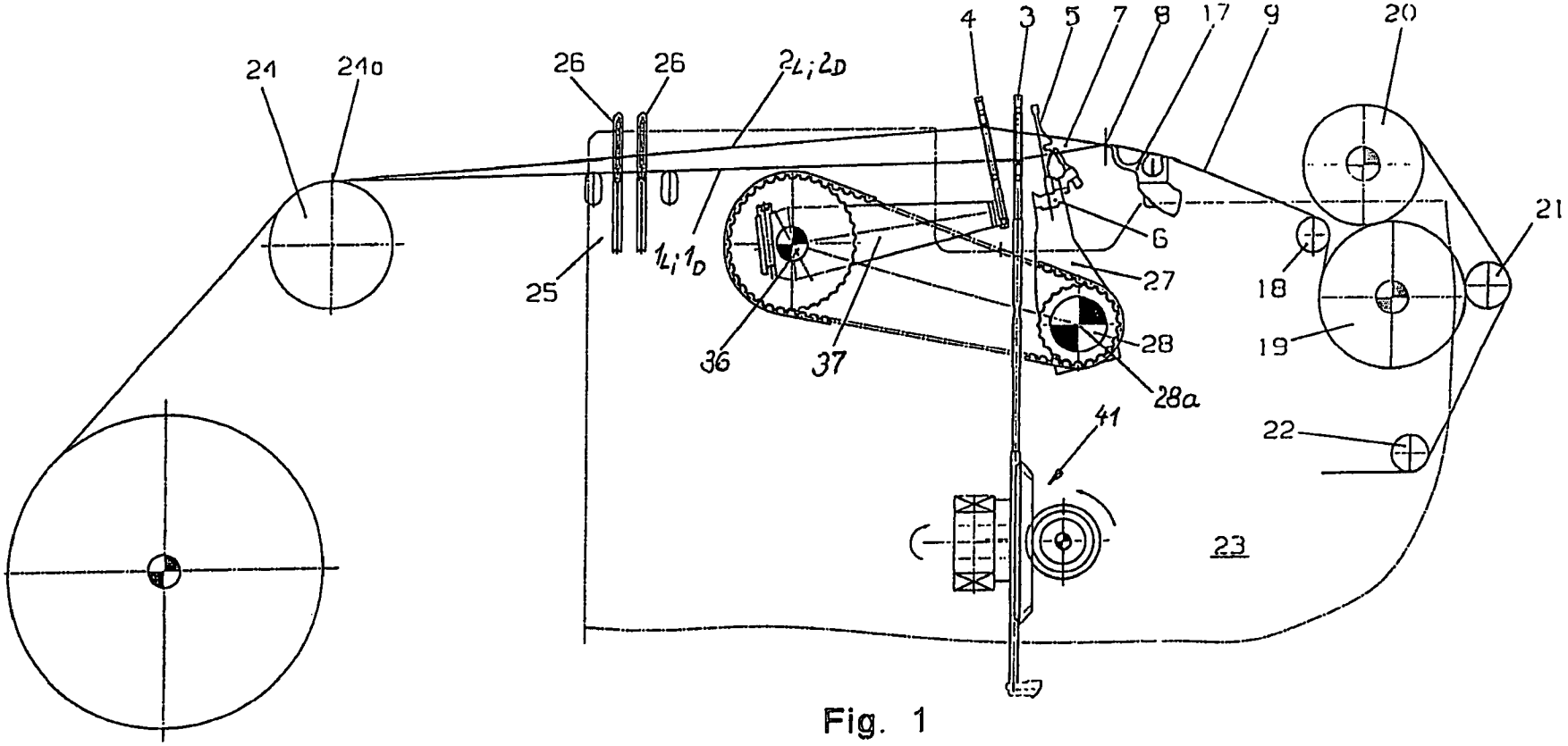
FIG. 1 is a cross-section and a schematic illustration of a loom according to the invention.

The loom which is schematically illustrated in FIG. 1 carries out a movement sequence according to which the warp threads $\mathbf{1}_L$ and $\mathbf{1}_D$ of a first warp thread bundle are located in the lower shed and are caused to move horizontally transversely to the supply of the first and second warp thread bundle, whilst the warp threads $\mathbf{2}_D$ of the second warp thread bundle are moved only vertically into the upper and lower shed. Accordingly, the blade and needle shaft 3 moves only transversely relative to the warp thread bundles, whilst the blade and needle shaft 4 having the warp threads $\mathbf{1}_L$ and $\mathbf{2}_L$ alternately carries out a substantially vertical upward and downward movement.

The insertion of a weft thread into the insertion duct of a weaving reed 5 which is mounted on a slay 6 takes place within the period of time in which a shed 7 is formed in each case, that is to say, the blade and needle shaft 4 is located in the position thereof illustrated in FIG. 1.

The beat-up operation of the weft thread, which is not illustrated in this instance, to the connection point 8 of the fabric 9 is carried out, for example, at a time at which the warp threads $\mathbf{1}_D$ change their position transversely relative to the supply of the warp thread bundles or in a horizontal direction.

Figure 10:
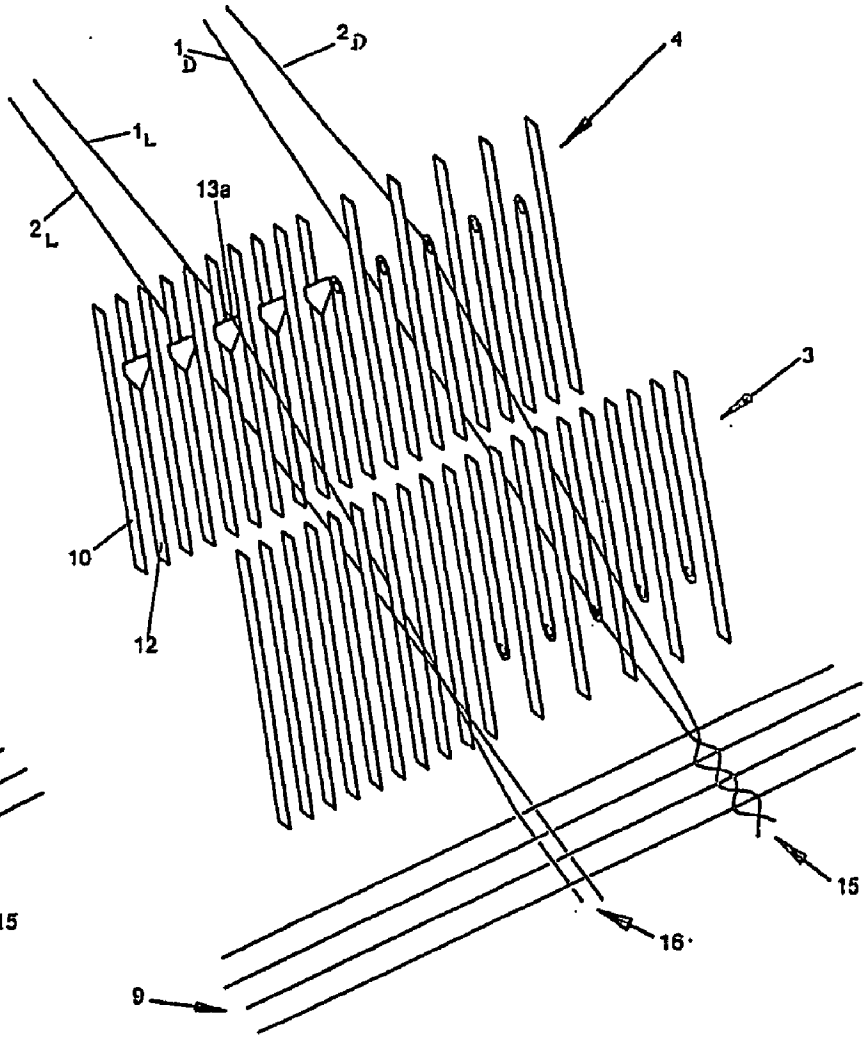
FIG. 10 illustrates the movement sequence of the first and second blade and needle shaft when a second leno and plain shed is formed.
Figure 9:
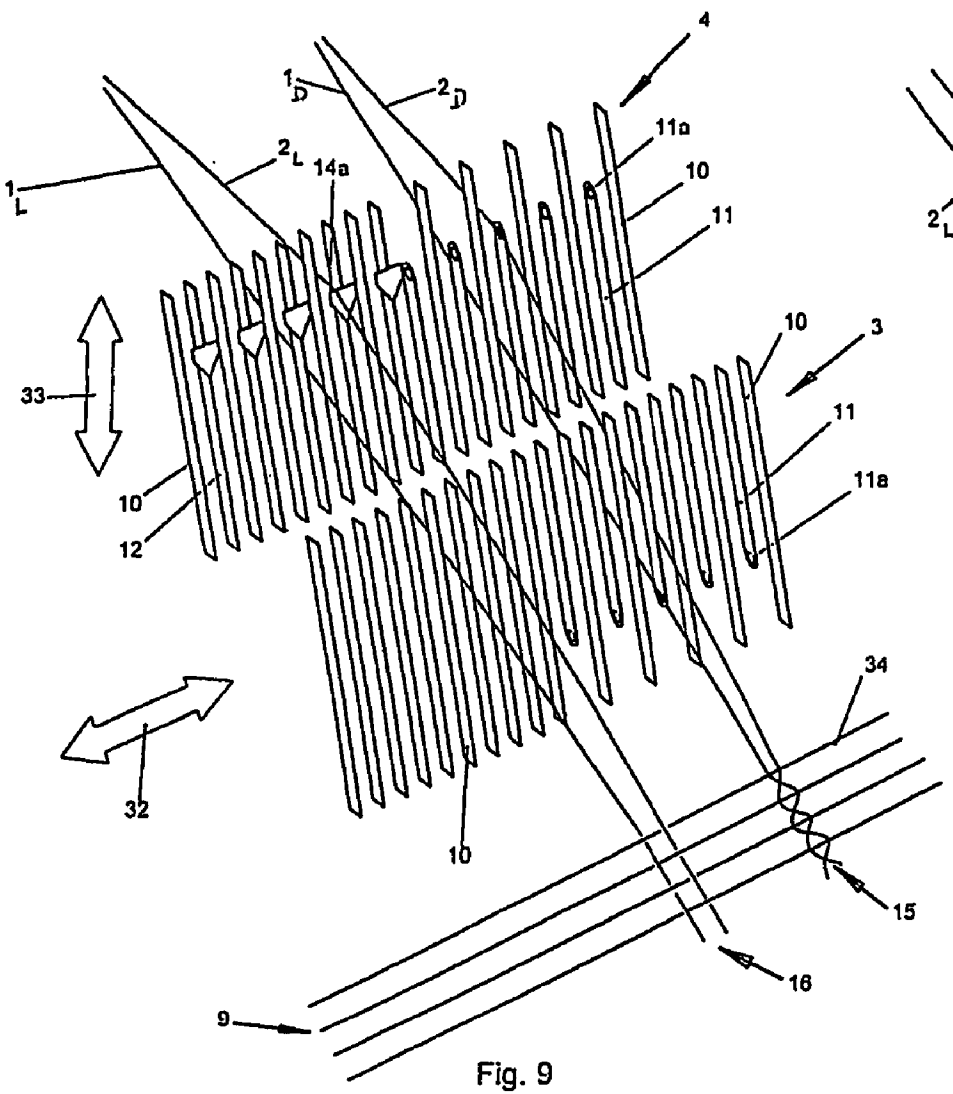
FIG. 9 illustrates the movement sequence of the first and second blade and needle shaft when a first leno and plain shed is formed.

Using a movement sequence of this type, the fabric is produced in leno weave 15, see also FIGS. 9 and 10. According to the invention, during a weaving cycle, that is to say, from one reed beat-up operation to the next, in addition to the above-mentioned leno weave 15, a fabric 9 is produced in plain weave 16, see also FIGS. 9 and 10, using the same shafts as are required for the leno weaves.

Figures 2, 3:
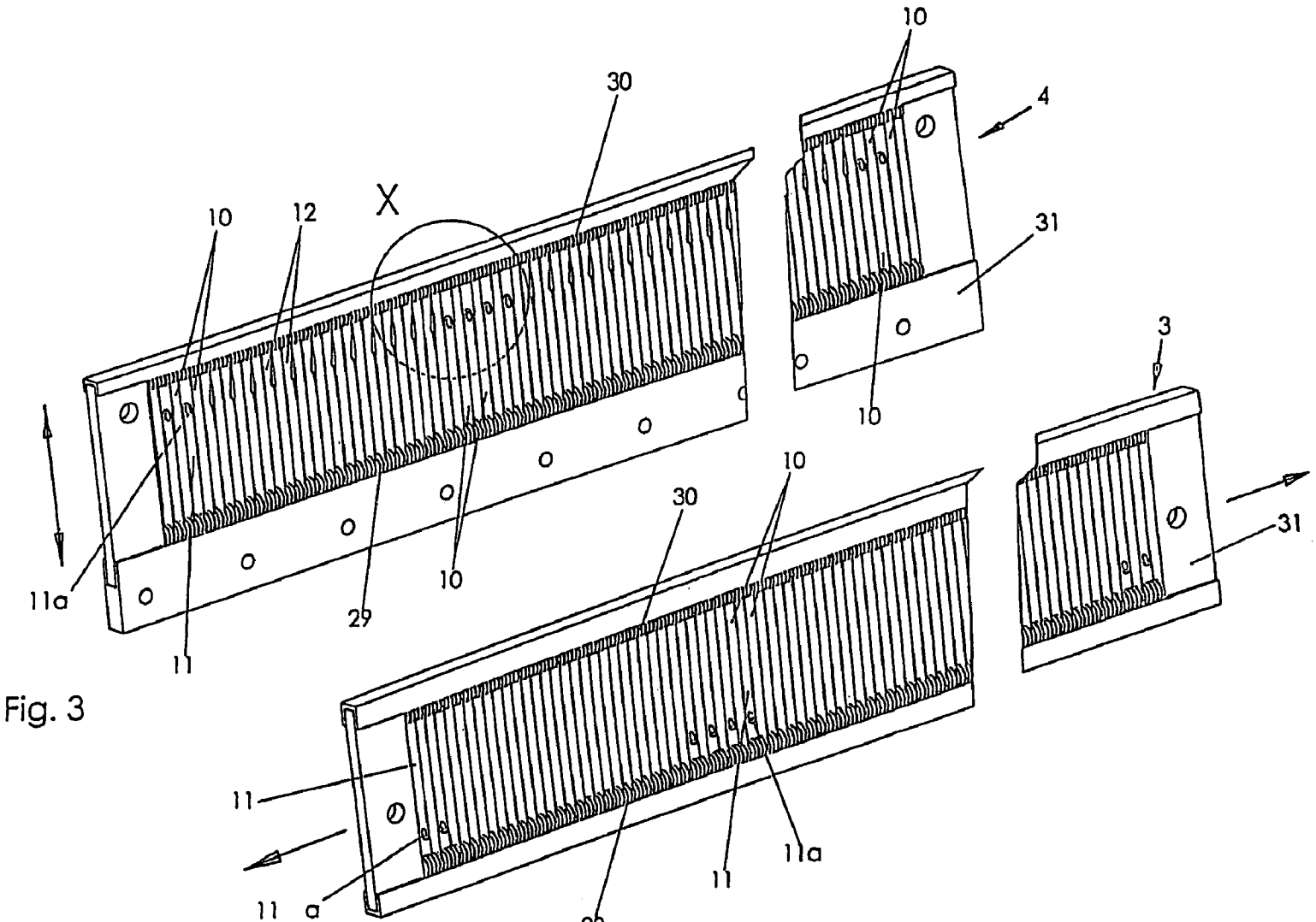
FIG. 2 is a perspective view of a blade/needle shaft as a stationary reed.
FIG. 3 is a perspective view of a blade/needle shaft as a pivoting reed.
Figures 4, 5, 6, 7, 8:
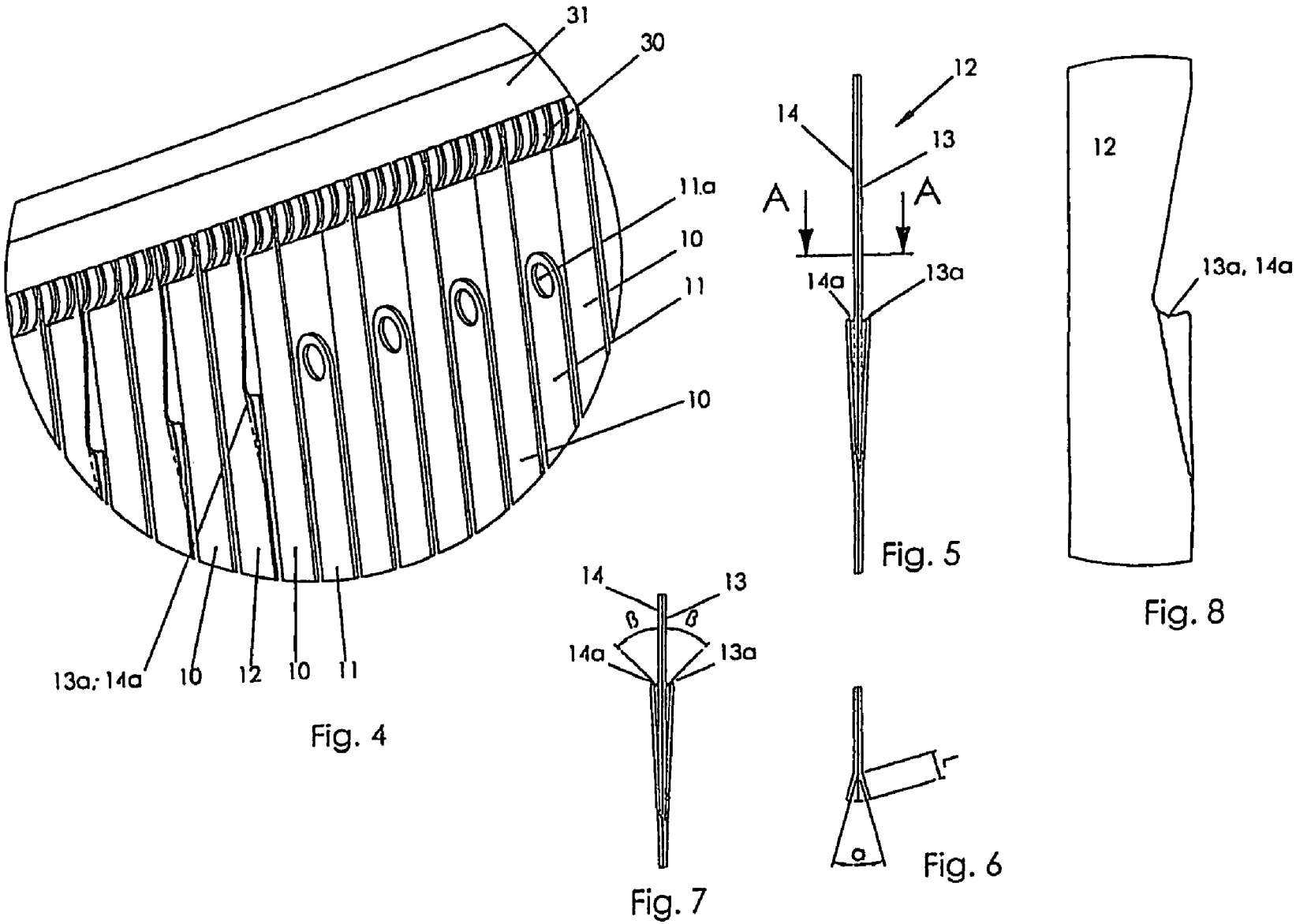
FIG. 4 is a perspective view of the detail "X" of FIG. 3.
FIG. 5 is a front view of a shoulder blade having a shoulder at both sides according to FIG. 3.
FIG. 6 is a sectional illustration of the shoulder blade along line A—A in FIG. 5.
FIG. 7 illustrates the construction of the shoulders of a shoulder blade according to FIG. 5.
FIG. 8 is a side view of the shoulder blade having a shoulder according to FIG. 5.

To this end, the blade and needle shaft 4 has, in addition to the usual rod blades 10 and the so-called needle blades 11 having a thread guiding eyelet 11*a*, see also FIGS. 3 and 4, according to the invention, shoulder blades 12 having shoulders 13*a*, 14*a* which are arranged or formed at both sides or at one side, as illustrated in particular in FIGS. 5 to 8.

The fabric 9 produced is directed, according to FIG. 1, via the fabric table 17 and a redirecting roller 18 to a draw-in roller 19, from where it passes through a clamping location between the draw-in roller 19 and a compression roller 20 via two redirecting rollers 21, 22 to the cloth beam (not illustrated in greater detail), on which it is wound.

The rollers mentioned are rotatably supported in a partially illustrated machine frame 23 which also carries the fabric table 17.

The drives which are associated with the rollers are known per se and are not illustrated in greater detail.

In the region between the point 24*a* of the backrest 24 and the blade and needle shafts 3, 4, the warp threads $\mathbf{1}_L$, $\mathbf{1}_D$ and $\mathbf{2}_L$, $\mathbf{2}_D$ extend through a warp thread stop motion device 25 whose blades 26 which travel on the warp threads $\mathbf{1}_L$, $\mathbf{1}_D$; $\mathbf{2}_L$, $\mathbf{2}_D$ and the warp threads $\mathbf{1}_L$, $\mathbf{1}_D$; $\mathbf{2}_L$, $\mathbf{2}_D$ are readily accessible in an unimpeded manner from above in the event of a warp thread breakage.

The slay 6 having the weaving reed 5 is securely connected, by means of supports 27, to a shaft, the so-called slay shaft 28, which is rotatably supported in the machine frame 23 and which carries out an oscillating rotation movement and about whose axis of rotation it carries out a back and forth movement which serves to beat up the weft thread.

The drive action of the slay shaft is generally known, so no further explanations are required in this regard.

The basic construction of the blade and needle shafts 3, 4 can be seen in FIGS. 2 and 3.

The blade and needle shafts 3, 4 have a lower shaft connection 29 and an upper shaft connection 30. Both shaft connections are surrounded by a frame, the so-called shaft frame 31.

Both blade and needle shafts 3, 4 have a plurality of rod blades 10 which are arranged in a mutually spaced-apart manner and whose respective ends are anchored in the upper and lower shaft connection 30, 29.

In order to be able to simultaneously form, in accordance with the method according to the invention, a plain weave 16 and a leno weave 15 in a fabric 9, as illustrated in FIGS. 9 and 10, a so-called shoulder blade 12 is provided according to the invention on a first available longitudinal portion of the cloth width of the blade and needle shaft 4 according to the invention between two rod blades 10 which are located beside each other, and so-called needle blades 11 having a thread guiding eyelet 11*a* are provided on a second predetermined longitudinal portion of the same blade and needle shaft 4 between the rod blades 10, which can best be seen in FIGS. 3 and 4.

Furthermore, a needle blade 11 having a thread guiding eyelet 11*a* is arranged in each case between two rod blades 10 on a second longitudinal portion of the cloth width of the blade and needle shaft 3 identical to the first longitudinal portion. The thread guiding eyelets 11*a* of the needle blades 11 of both blade and needle shafts 3, 4 are directed away from each other.

A shoulder blade 12 according to the invention is illustrated in FIG. 5.

The shoulder blade 12 comprises in this instance a first single rod blade 13 having a so-called half shoulder 13*a* and a second single rod blade 14 having a half shoulder 14*a*. Both half shoulders 13*a*, 14*a* in this instance have a trough-like recess as a temporary warp thread carrier.

In FIGS. 9 and 10, the shoulders which temporarily carry a warp thread $\mathbf{1}_L$, $\mathbf{2}_L$ are constructed so as to have a planar surface. In FIG. 7, the shoulders are orientated at an angle $\beta \leqq 90°$ relative to the longitudinal extent of the blade 13, 14 so that the relevant warp thread $\mathbf{1}_L$, $\mathbf{2}_L$ can be securely raised to form the shed and can slide securely from the shoulder in the lower shed.

According to the sectional illustration A—A in FIG. 6, both shoulders 13*a*, 14*a* can enclose an angle $\alpha < 180°$ and have a member length L such that, on the one hand, contact with the adjacent rod blades 10 is prevented and, on the other hand, a sufficiently large lateral clearance is provided between the shoulder 13*a*, 14*a* and the adjacent rod blade 10 for alternately receiving and removing warp threads $\mathbf{1}_L$, $\mathbf{2}_L$.

FIG. 8 is a lateral view of a shoulder blade 12 having the trough-like recess in the shoulder 13*a*, 14*a* for a warp thread $\mathbf{1}_L$ or $\mathbf{2}_L$.

The method for producing a fabric with plain weaves and leno weaves being formed at the same time will now be explained with reference to FIGS. 9 and 10.

The blade and needle shafts 3,4 which are schematically illustrated in FIG. 9 comprise, as set out above, rod blades 10 and needle blades 11 having a thread guiding eyelet 11*a*.

Only the blade and needle shaft 4 additionally has shoulder blades 12.

The blade and needle shaft 3 carries out an oscillating back and forth movement transversely relative to the supply of the warp threads $\mathbf{1}_L$, $\mathbf{1}_D$; $\mathbf{2}_L$, $\mathbf{2}_D$. The back and forth movement is indicated by the directional arrow 32.

The blade and needle shaft 4 carries out a substantially vertically oscillating upward and downward movement, as indicated by the directional arrow 33.

The warp threads $\mathbf{1}_L$, $\mathbf{2}_L$ are drawn into the gaps between the shoulder blades 12 and the rod blades 10 of the blade and needle shaft 4 on the one hand and into the gaps between the rod blades of the blade and needle shaft 3 on the other hand, in order to form a plain weave 16. A warp thread $\mathbf{1}_D$ is in each case drawn into the thread guiding eyelet 11*a* of each needle blade 11 of the blade and needle shaft 4 and a warp thread $\mathbf{2}_D$ is in each case drawn into the thread guiding eyelet 11*a* of each needle blade 11 of the blade and needle shaft 3 in order to produce a leno weave.

When the shaft 4 is lowered into the lower shed, in accordance with the direction of the downwardly directed double-headed arrow 33, this corresponds in FIG. 9 to the position of the warp threads $\mathbf{1}_L$, $\mathbf{1}_D$ and, when the blade and needle shaft 3 is moved at the same time transversely to the right in the direction of the double-headed arrow 32, the corresponding warp threads $\mathbf{2}_L$ are positioned by means of the blades 10 on the left-hand shoulder 14*a* and right-hand shoulder 13*a* of the shoulder blades 12. Subsequently, the blade and needle shaft 4 moves out of the position of the lower shed into the position of the upper shed, whereby the warp threads $\mathbf{1}_L$ and $\mathbf{2}_L$ form a plain shed.

In the same manner, all the warp threads $\mathbf{2}_D$ of the blade and needle shaft 4 which have been guided through the thread guiding eyelets 11*a* are moved out of the position of the lower shed into the position of the upper shed, whereby the warp threads $\mathbf{1}_D$ and $\mathbf{2}_D$ form a leno weave.

Subsequently, a weft thread 34 is inserted into the plain and leno shed 7 formed, is beaten-up to the connection point 8 by the weaving reed 7 according to FIG. 1 and, by the blade and needle shaft 4 changing shed from the upper shed to the lower shed, is bound by means of the warp threads $\mathbf{2}_L$ and $\mathbf{2}_D$. According to FIG. 10, whilst the blade and needle shaft is in the lower shed position, the plain weave warp threads $^1$L are positioned on the shoulder 13*a* or 14*a* of the relevant shoulder blades 12 by means of another transverse movement of the blade and needle shaft 3, in order to be able to form a plain shed and a leno shed again.

Figure 11:
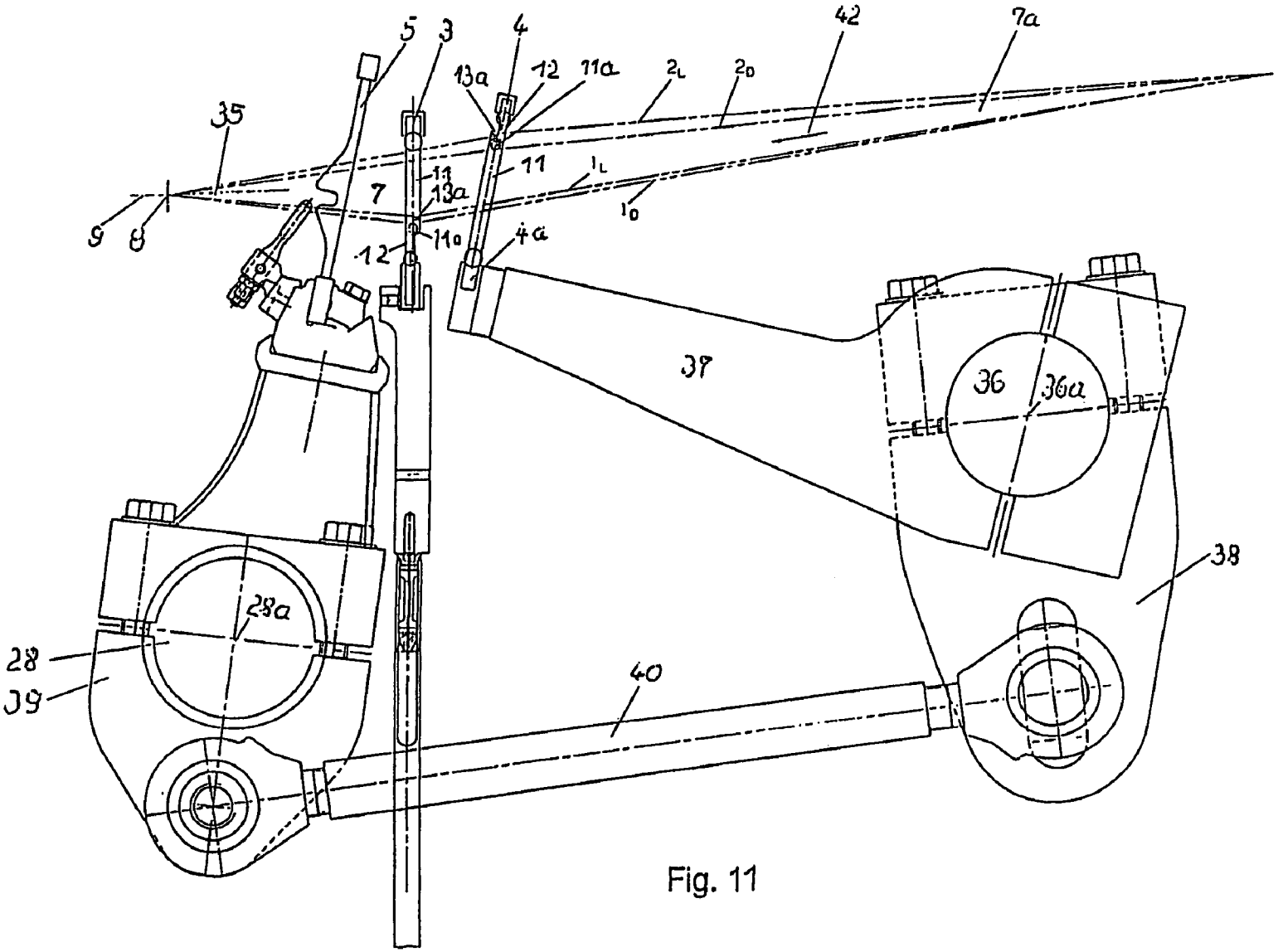
FIG. 11 is a lateral view of the relevant means for the solution according to the invention for a loom, with the plain weave and leno weave warp threads being raised into the upper shed position.

In another configuration of the invention, the means for producing a fabric having plain weaves and leno weaves according to FIG. 11 comprise a warp which is supplied by a warp beam which is not illustrated in this instance and which comprises plain weave warp threads $\mathbf{1}_L$ and $\mathbf{2}_L$ and leno weave warp threads $\mathbf{1}_D$ and $\mathbf{2}_D$.

The warp threads mentioned are, starting from the connection point 8 of the fabric 9, successively drawn into a weaving reed 5 which is driven in a pivoting manner so as to move about the centre axis 28*a* of the slay shaft 28, into a first blade and needle shaft 3 which is movingly driven back and forth transversely relative to the weaving plane 35 and into a second blade and needle shaft 4 which is driven in a pivoting manner so as to move about the centre axis 36*a* of a pivoting arm shaft 36 which is located remote from the weaving reed shaft.

As already disclosed above, the first blade and needle shaft 3 has a plurality of rod blades 10 and, at locations provided in each case between two rod blades 10, a needle blade 11 having a thread guiding eyelet 11*a*, see also FIGS. 9 and 10.

The warp threads $\mathbf{1}_L$ and $\mathbf{2}_L$ are alternately received between the rod blades 10 of the first blade and needle shaft 3 in order to form a plain weave fabric 9 whilst a warp thread $\mathbf{1}_D$ is guided in each thread guiding eyelet 11*a* of the needle blades 11 in order to form a leno weave fabric 9 or a leno edge as a closure for a plain weave fabric portion.

Accordingly, the second blade and needle shaft 4 also has a plurality of rod blades 10, a so-called shoulder blade 12 being positioned between two rod blades 10 in each case in order to form the plain weaves, which shoulder blade 12 has a shoulder 13*a*, 14*a* for alternately receiving a warp thread $\mathbf{1}_L$ or $\mathbf{2}_L$. In the blade and needle shaft 4, a needle blade 11 having a thread guiding eyelet 11*a* is also provided at locations provided in each case between two rod blades 10 and, together with the needle blades 11 having a thread guiding eyelet 11*a* of the first blade and needle shaft 3, forms the leno weave fabric 9 or single leno weaves.

In another configuration of the invention, in order to prevent faulty plain weave fabric 9 caused by hooking warp threads in the region of the rear shed 7*a*, a shoulder blade 12 is also arranged alternately between each even-numbered or each odd-numbered rod blade 10 of the first blade and needle shaft 3 or the relevant rod blade 10 is constructed as a shoulder blade 12, with a trough-like recess 13*a* which terminates substantially in a hook and which is vertically open downwards in order to alternately retain the warp threads $\mathbf{1}_L$ or $\mathbf{2}_L$ if these are not moved into the upper shed during shed formation by the second blade and needle shaft 4, see also FIGS. 11 to 14.

The means for forming a shed 7 which is formed by an upper shed and a lower shed comprise in this instance the second blade and needle shaft 4 having the above-mentioned rod, shoulder and needle blades.

The blade and needle shaft 4 is connected to the lower connection 4*a* thereof at the free end of at least one pivoting arm 37 which engages on the pivoting arm shaft 36 in a rotationally secure manner.

The pivoting arm shaft 36 has a connection tab 38. The slay shaft 28 is also equipped with a connection tab 39. Both connection tabs 38, 39 are coupled by means of a rod 40.

Figure 12:
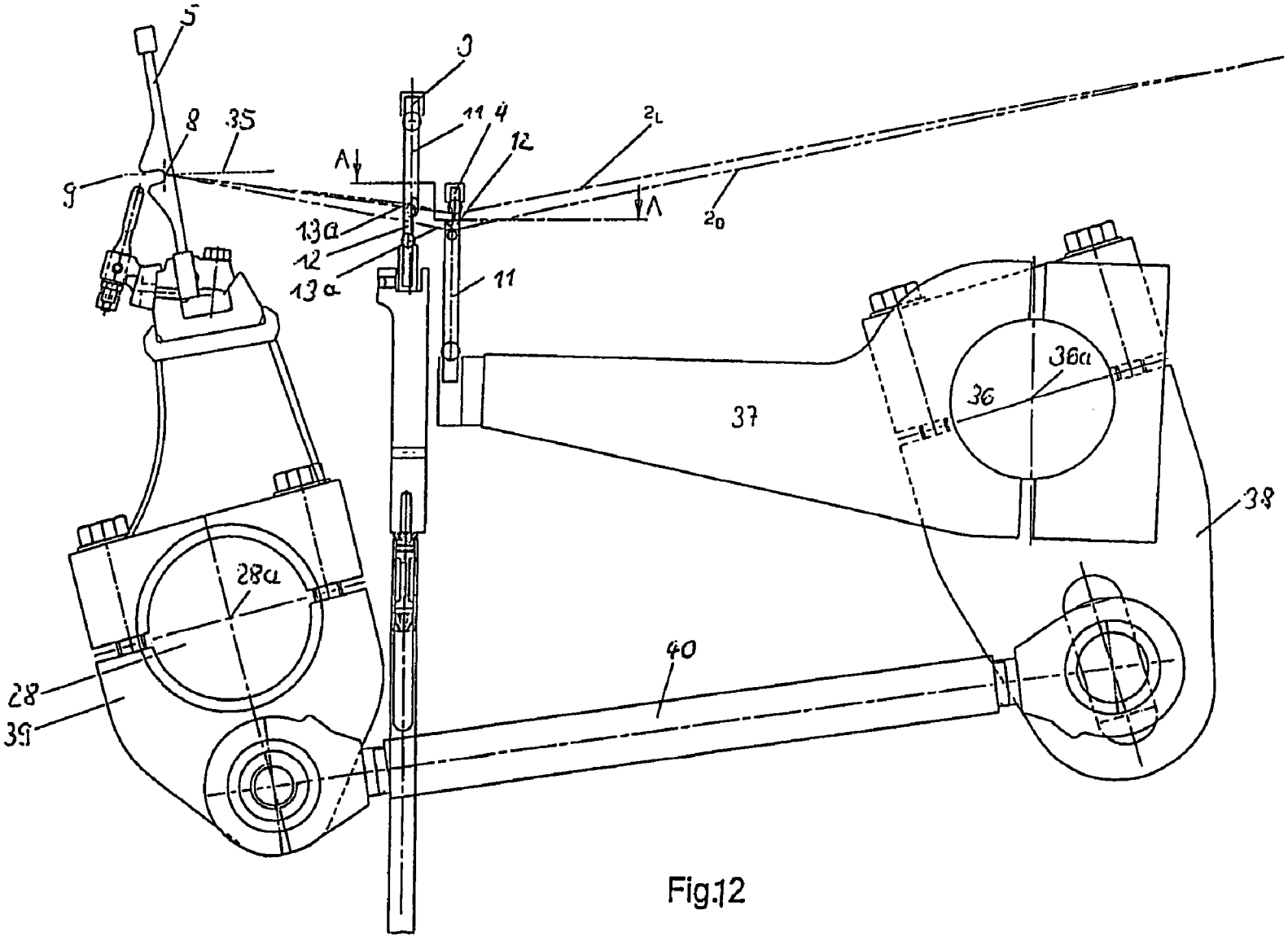
FIG. 12 illustrates the relevant means for the solution according to the invention for a loom according to FIG. 11, with the plain weave and the leno weave warp threads being lowered from the upper shed position into the lower shed position.

In FIG. 12, the warp threads $\mathbf{2}_L$ and $\mathbf{2}_D$ are guided by the second blade and needle shaft 4 into the lower shed position, that is to say, positioned below the weaving plane 35.

Figure 14:
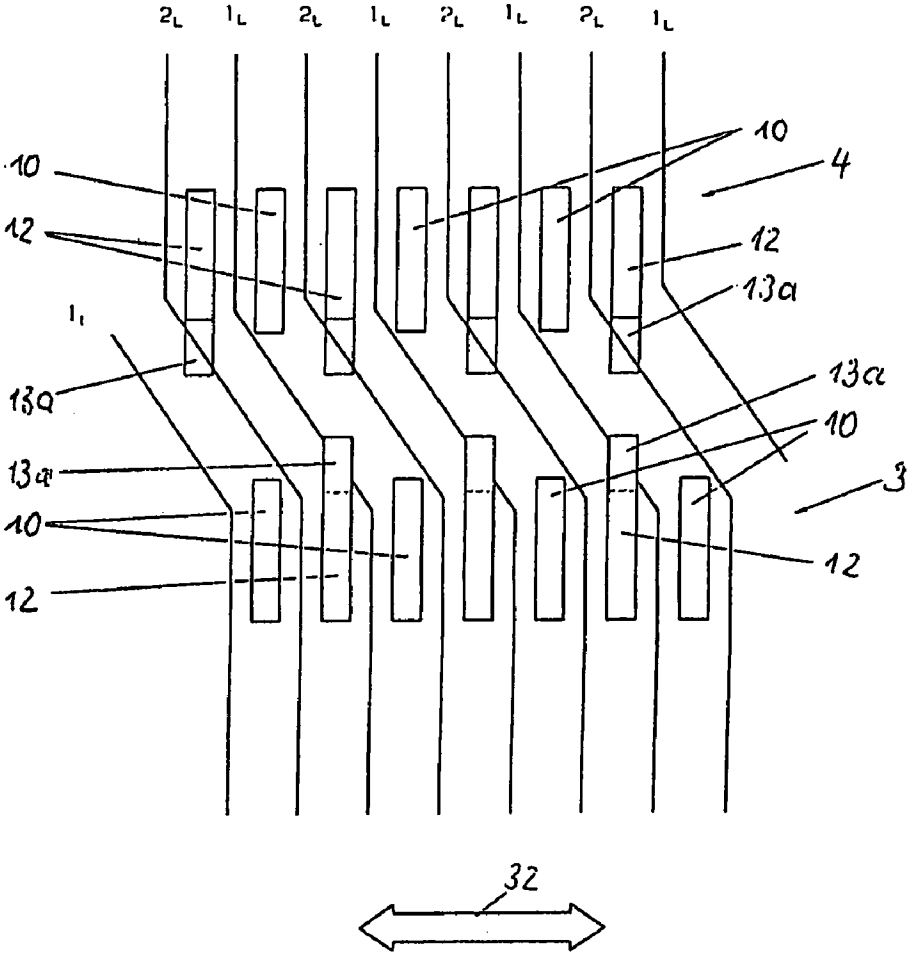
FIG. 14 is a schematic illustration according to FIG. 13, the first blade and needle shaft assuming the right-hand change-over position transversely relative to the weaving plane.
Figure 13:
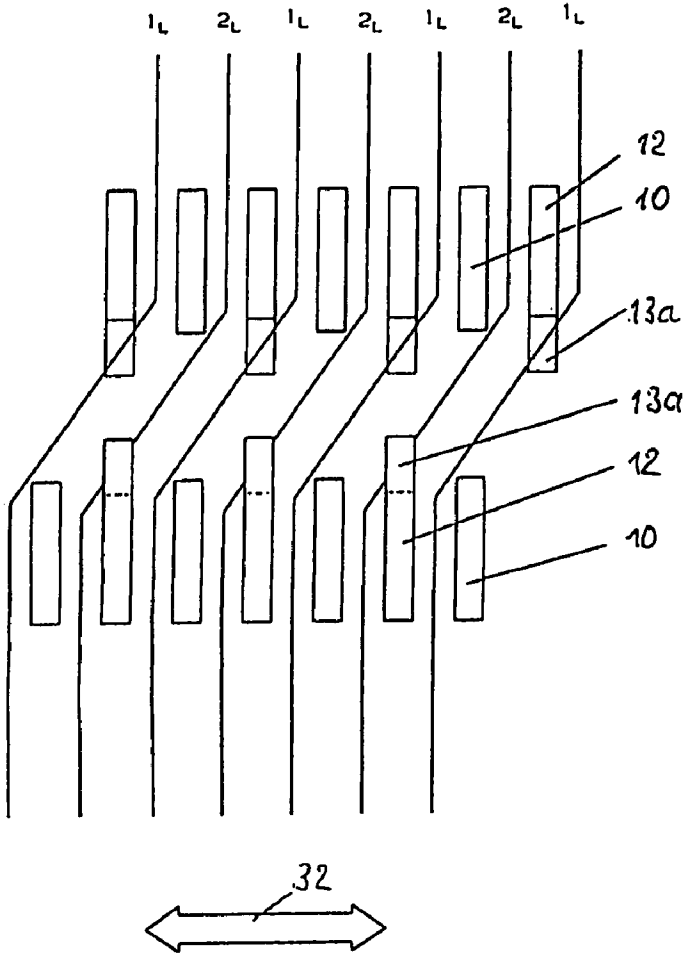
FIG. 13 is a schematic view of the first and second blade and needle shafts along line A—A in FIG. 12, the first blade and needle shaft assuming the left-hand change-over position transversely relative to the weaving plane.

Whilst in this position, the first blade and needle shaft 3 is moved by means of a drive which is not illustrated in this instance, according to FIGS. 13 and 14, transversely relative to the weaving plane 35 according to the double-headed arrow 32 out of the extreme right-hand position thereof, see also FIG. 14, into the extreme left-hand position, see also FIG. 13. Accordingly, the first blade and needle shaft 3, in order to form a new plain shed, causes the warp threads $\mathbf{2}_L$ which have been guided into the lower shed to be guided out of the recess 13*a* of the shoulder blades 12 of the second blade and needle shaft 4 and into the recess 13*a* of the shoulder blades 12 of the first blade and needle shaft 3, whilst the warp threads $\mathbf{1}_L$ which are retained in the recesses 13*a* of the shoulder blades 12 are guided out of those recesses and into the recess 13*a* of the shoulder blades 12 of the second blade and needle shaft 4.

Owing to the fact that the relevant rod blades of the first blade and needle shaft 3 are also in the form of shoulder blades 12 and the relevant warp thread $\mathbf{1}_L$ or $\mathbf{2}_L$ is retained during the production of the shed, weaving errors in the plain weave fabric are prevented.

The invention claimed is:

1. Loom for producing a fabric which has both plain weaves (16) comprising weft threads (34) and warp threads ($\mathbf{1}_L$, $\mathbf{2}_L$) and leno weaves (15) comprising weft threads (34) and warp threads ($\mathbf{1}_D$, $\mathbf{2}_D$), the loom comprising:

a slay (6) which includes a slay shaft and which carries a weaving reed (5) and which carries out an oscillating pivoting movement about a longitudinal center axis (28*a*) of the slay shaft (28), a first blade and needle shaft (3) which is connected to a drive (41) which brings about an oscillating back and forth linear movement of the first blade and needle shaft (3) transversely relative to a weaving plane (35) and a second blade and needle shaft (4) which is adjacent to the first blade and needle shaft (3) and which is connected in a rotationally secure manner by connection means (37) to a remote shaft (36) which is arranged remote from the slay shaft (28) and which carries out an oscillating forward and backward rotational movement about a center axis (36*a*) of the remote shaft, characterized in that, in order to produce the leno weaves (15), a needle blade (11) having a thread guiding eyelet (11*a*) is connected respectively in each case between two rod blades (10) which are arrested at an upper shaft connection (30) and a lower shaft connection (29) of the first and second blade and needle shaft (3;4), and, in order to form the plain weaves (16), a plurality of rod blades (10) are arranged beside each other in the first blade and needle shaft (3), with which rod blades (10) there is associated a shoulder blade (12), having a shoulder (13*a*,14*a*) which is arranged at one side or at both sides for supporting at least one of the warp threads ($\mathbf{1}_L$, $\mathbf{2}_L$) of the plain weaves, in the second blade and needle shaft (4) of either each even-numbered or each odd-numbered one of the rod blades (10) of the first blade and needle shaft (3).

2. Loom according to claim 1, characterized in that a support of the shoulders (13*a*, 14*a*) which carries the at least one of the warp thread threads ($\mathbf{1}_L$, $\mathbf{2}_L$) of the plain weaves is formed substantially in a plane of the thread guiding eyelets (11*a*) of the second blade and needle shaft (4).

3. Loom for producing a fabric which has both plain weaves (16) comprising weft threads (34) and warp threads ($\mathbf{1}_L$, $\mathbf{2}_L$) and leno weaves (15) comprising weft threads (34) and warp threads ($\mathbf{1}_D$, $\mathbf{2}_D$), the loom comprising:

a slay (6) which includes a slay shaft and which carries a weaving reed (5) and which carries out an oscillating pivoting movement about a longitudinal center axis (28*a*) of the slay shaft (28), a first blade and needle shaft (3) which is connected to a drive (41) which brings about an oscillating back and forth linear movement of the first blade and needle shaft (3) transversely relative to a weaving plane (35) and a second blade and needle shaft (4) which is adjacent to the first blade and needle shaft (3) and which is connected in a rotationally secure manner by connection means (37) to a remote shaft (36) which is arranged remote from the slay shaft (28) and which carries out an oscillating forward and backward rotational movement about a center axis (36*a*) of the remote shaft.

a needle blade (11) having a thread guiding eyelet (11*a*) being connected respectively in each case between two rod blades (10) which are arrested at an upper shaft connection (30) and a lower shaft connection (29) of the first and second blade and needle shaft (3;4) in order to form the leno weaves (15), and, in order to form the plain weaves (16), a plurality of rod blades (10) being arranged beside each other in the first blade and needle shaft (3), with which rod blades (10) there is associated a shoulder blade (12), having a shoulder (13*a*,14*a*) which is arranged at one side or at both sides for supporting at least one of the warp threads ($\mathbf{1}_L$, $\mathbf{2}_L$) of the plain weaves, in the second blade and needle shaft (4) of either each even-numbered or each odd-numbered one of the rod blades (10) of the first blade and needle shaft (3), characterized in that, in order to form the plain weaves (16), each one of the even-numbered or each one of the odd-numbered rod blades (10) of the first blade and needle shaft (3) is also a shoulder blade (12) which has at least a shoulder at one side counter to a direction (42) of supply of the warp threads ($\mathbf{1}_L$,$\mathbf{2}_L$; $\mathbf{1}_D$,$\mathbf{2}_D$) having a downwardly open trough-like recess in the shoulder (13*a*;14*a*) for retaining first ones of the warp threads ($\mathbf{1}_L$) or second ones of the warp threads ($\mathbf{2}_L$) of the plain weaves.

4. Loom according to claim 3, characterized in that the shoulder (13*a*;14*a*) of the shoulder blades (12) that respectively retains at least one of the warp threads ($\mathbf{1}_L$, $\mathbf{2}_L$) of the plain weaves is formed substantially in a plane of the thread guiding eyelet (11*a*) of the needle blades (11) of the first blade and needle shaft (3).

* * * * *

UNITED STATES PATENT AND TRADEMARK OFFICE

CERTIFICATE OF CORRECTION

PATENT NO. : 7,225,838 B2
APPLICATION NO. : 10/546444
DATED : June 5, 2007
INVENTOR(S) : Wahhoud et al.

It is certified that error appears in the above-identified patent and that said Letters Patent is hereby corrected as shown below:

Title page,
Item [57], ABSTRACT,
Line 3, after "threads", replace "($1_L$,$2_L$)" by --($1_L$, $2_L$)--;

Column 1,
Line 15, after "loom", replace "a" by --for--;

Column 7,
Line 42, after "threads", replace "$^1$L" by --$1_L$--;

Column 9,
Line 40, after "warp", delete --thread--;

Column 10,
Line 14, after "shaft", replace "." by --,--.

Signed and Sealed this

Twenty-seventh Day of May, 2008

JON W. DUDAS
*Director of the United States Patent and Trademark Office*